US006317021B1

(12) United States Patent
Jansen

(10) Patent No.: US 6,317,021 B1
(45) **Date of Patent: *Nov. 13, 2001**

(54) VARIABLE INDUCTOR

(75) Inventor: Arian M. Jansen, Thousand Oaks, CA (US)

(73) Assignee: NMB (USA) Inc., Chatsworth, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/080,555

(22) Filed: May 18, 1998

(51) Int. Cl.[7] ..... H01F 21/08; H01F 27/24

(52) U.S. Cl. ..... 336/155; 336/214; 336/215; 336/212

(58) Field of Search ..... 336/214, 215, 336/233, 155, 160, 212

(56) References Cited

U.S. PATENT DOCUMENTS

| | | | | |
|---|---|---|---|---|
| 390,245 | * | 10/1888 | Mather | 336/214 |
| 2,229,952 | | 1/1941 | Whiteley et al. . | |
| 2,317,602 | | 4/1943 | Hall, Jr. et al. . | |
| 2,550,500 | * | 4/1951 | Schell, Jr. | 336/214 |
| 2,552,203 | | 5/1951 | Morgan . | |
| 2,896,182 | * | 7/1959 | Pruneau | 336/215 |
| 2,932,787 | | 4/1960 | Krabbe et al. . | |
| 2,991,437 | * | 7/1961 | Kreuzer | 336/215 |
| 3,631,534 | | 12/1971 | Hirota et al. . | |
| 3,708,775 | * | 1/1973 | Haddock, Jr. et al. | 336/215 |
| 5,426,409 | | 6/1995 | Johnson . | |

FOREIGN PATENT DOCUMENTS

| | | | | |
|---|---|---|---|---|
| 356227 | * | 7/1922 | (DE) | 336/155 |
| 715610 | | 9/1954 | (GB) . | |

OTHER PUBLICATIONS

Austin, Douglas, II, "Fundamentals of Inductors", *Wound Magnetics Journal* (no date).

* cited by examiner

*Primary Examiner*—Anh Mai
(74) *Attorney, Agent, or Firm*—Schlute Roth & Zabel; Joel Lutzker; Donna Angotti

(57) ABSTRACT

A variable inductor with a saturable core having three legs, including a center leg and two outer legs. A control winding is wound on the center leg and two outer windings are connected in parallel and wound on the outer legs. The inductances of the windings on the outer legs vary with the current through the control winding. The current through the control winding varies the saturation level of the outer legs. In one embodiment, the inductance of the control winding is substantially constant with a change in current in the control winding. In another embodiment, the outer legs are saturated and the center leg is not saturated. Portions of the core connecting the three legs are tapered down from the cross-section of the center leg to the cross-sections of the outer legs. The invention further includes methods of varying the inductance of an inductive circuit element in accordance with a control current.

14 Claims, 3 Drawing Sheets

FIG. 3
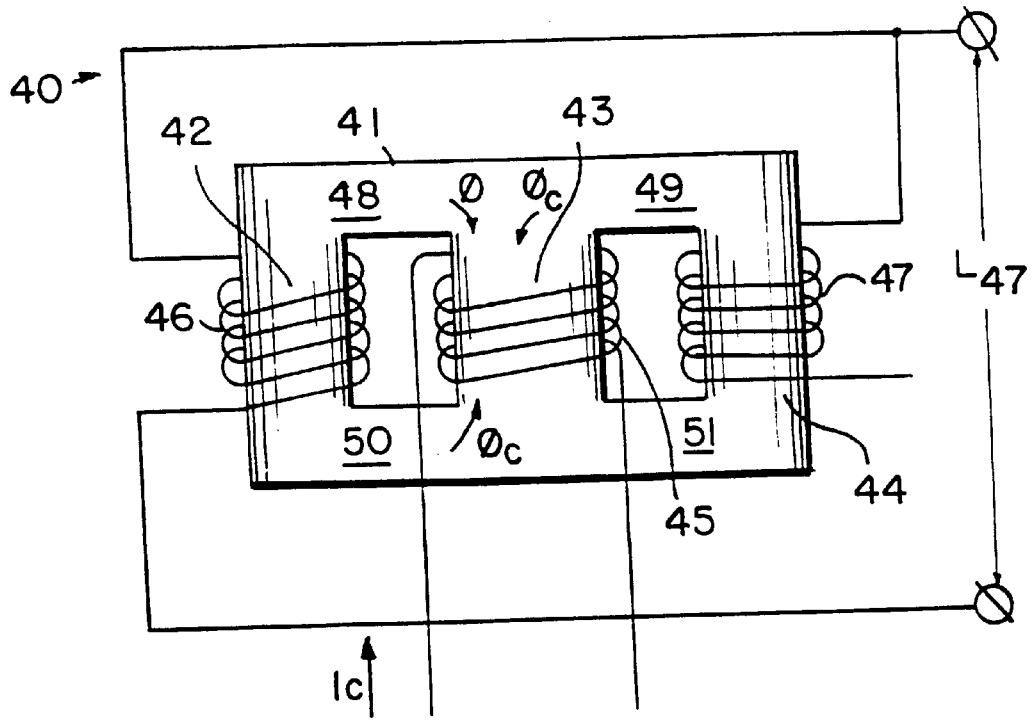
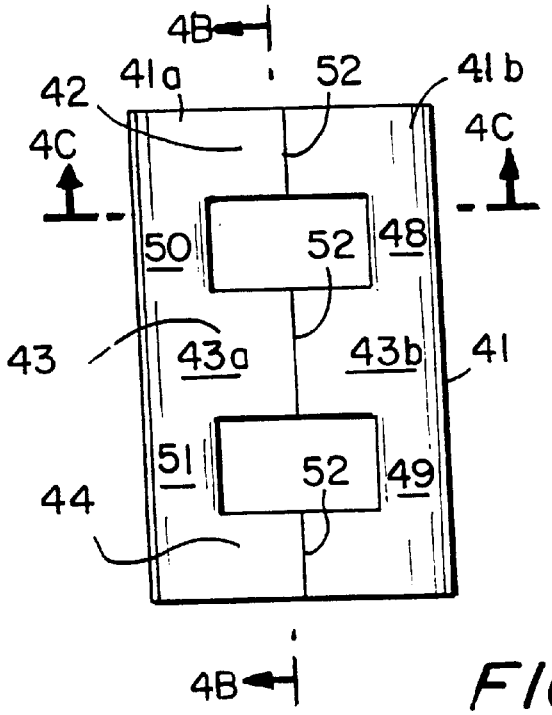
FIG. 4A

FIG. 4B
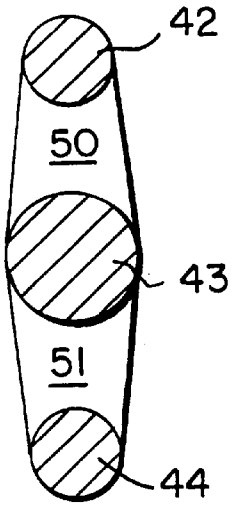
FIG. 4C
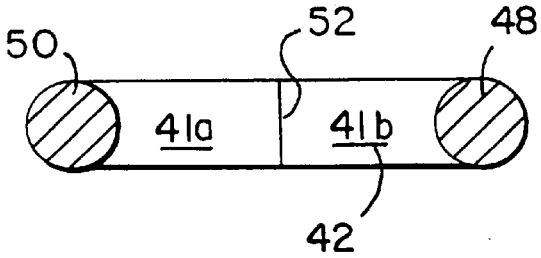
FIG. 4D
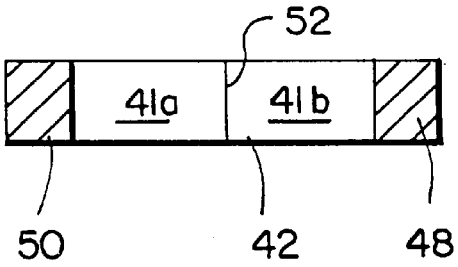
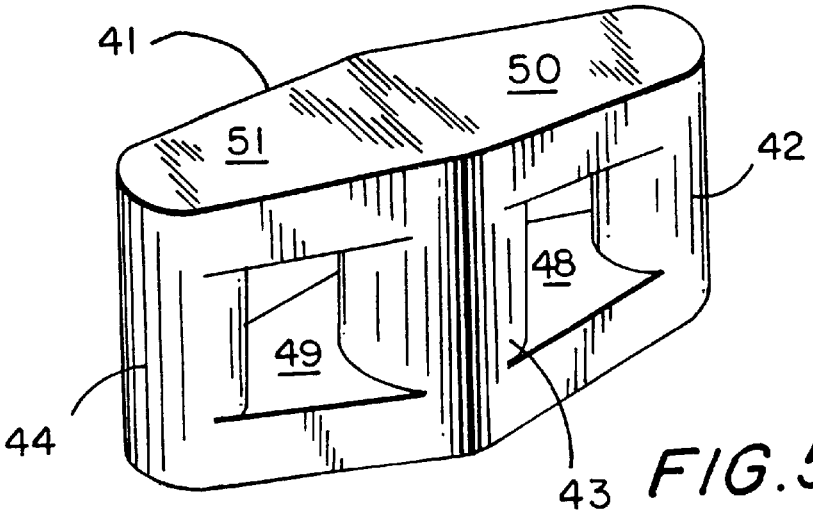
FIG. 5

VARIABLE INDUCTOR

FIELD OF THE INVENTION

This invention relates to a variable inductor and a method of varying the inductance of an inductive circuit element. In particular, the invention relates to a variable inductor in which the inductance of an inductive circuit element is varied by means of an electrical signal.

BACKGROUND OF THE INVENTION

Variable inductors are of use in many circuit applications including magnetic amplifiers which vary the inductance of a circuit element to regulate power and resonant circuits which vary the inductance of circuit elements to vary the resonant frequency of the circuit. The simplest way to obtain a variable inductor is by mechanical movement of a connector along an inductive element. However, it is frequently desirable to vary the inductance of a circuit element by means of an electrical signal rather than by mechanical movement.

The saturation effect of magnetic materials may be employed to create a current controlled variable inductor such as that shown in prior art FIG. 1. Variable inductors of this type typically have a limited variation range of 1 to 10 and suffer from parasitic effects such as capacitance and voltage across each series control winding that limit the quality factor of the inductor. Additionally, such current controlled variable inductors of the prior art typically require very high control currents in the range of 0 to 500 mA. FIG. 1 illustrates a current controlled variable inductor of the above-mentioned prior art in which the inductance $L_{14}$ of center winding 14 is controlled by the current Ic delivered to outer control windings 12 and 13.

More particularly, FIG. 1 shows a magnetic core 11, consisting of a magnetic material that can be saturated, with three legs 15, 16 and 17. The outer legs 15 and 17 have identical windings 12 and 13 that are connected in series as shown. Control windings 12 and 13 are wound and connected in such a way that the magnetic flux $\phi_c$ in respective legs 15 and 17 of the core arising from the control current Ic through the outer windings 12 and 13 is equal and points in opposite directions. The opposing magnetic flux $\phi_c$ results in cancellation in the center leg 16 of the core. The flux cancellation prevents coupling of AC signals between the center winding 14 and the series control windings 12 and 13. If an AC voltage were applied across the terminals of center winding 14, a voltage would be induced in both of the series windings 12 and 13 but the voltages in the control windings 12 and 13 would be of opposite polarity such that the voltage across the series connection of control windings 12 and 13 would remain zero. The magnetic path for center winding 14 includes outer legs 15 and 17, center legs 16 and the connecting portions 18–21. If the control current Ic through windings 12 and 13 becomes large enough to saturate the legs 15 and 17 of the core, the inductance $L_{14}$ of center winding 14 decreases because a portion of the magnetic path for the center winding 14 is saturated. The higher the control current Ic becomes, the lower the inductance $L_{14}$ becomes. However, the center leg 16 will not be saturated due to the control current Ic.

The inductance of an inductive circuit element is related to the permeability of the core and the number of turns:

$$L = \mu_o N^2 \frac{A}{l} \qquad \text{Equation (1)}$$

where L is the inductance of an inductive circuit element;

$\mu_0$ is the permeability of the magnetic core;

A is the cross-sectional area of the magnetic core;

N is the number of turns of the inductive element; and l is the length of the inductive element.

In accordance with Equation 1 since the center leg is not saturated, the minimum inductance $L_{14}$ is limited by the number of turns and the magnetic permeability of the core material of the center leg 16. Another undesirable side effect of the prior art circuit of FIG. 1 is that the inductance of each of the series connected control windings 12 and 13 changes substantially with a change in the value of the control current Ic. In fact, the inductances of the control windings 12 and 13 change by a greater amount than the inductance of the center winding 14. This condition establishes significant limitations when the prior art variable inductor is part of a regulation loop. The inductor of the prior art circuit FIG. 1 has a limited variation range or requires a very high control current in the order of about 0 to 500 mA. Further, the voltage across each control winding 12 and 13 and the parasitic capacitances of control windings 12 and 13 limit the winding ratio and/or the operating frequency. The inductance of the control windings 12 and 13 changes substantially with the control current Ic.

U.K. Patent 715,610 discloses variable inductive elements having saturable cores. The U.K. '610 variable inductors are illustrated in FIGS. 2A and 2B. The variable inductor of FIG. 2A has series windings on the outer legs of a three leg core, and accordingly is similar to FIG. 1 above. FIG. 2B illustrates parallel windings on the outer legs of a three leg core and a control winding on the center leg of the core. There is no teaching in the '610 U.K. Patent to set the magnetic cross-section of the center leg, relative to the magnetic cross-sections of the outer legs in a variable inductor so that the outer legs and the center leg have substantially equal levels of saturation, in order to obtain a substantially constant inductance of the control winding with a change in current of the control winding. Further, there is no teaching in the '610 U.K. Patent to taper the portions of a three leg core connecting the legs down from the cross-section of the center leg to the cross-sections of the outer legs in order to obtain the largest variation in inductance for a given control current. Further, the '610 U.K. Patent teaches the use of an additional body or additional lamination strips to add cross-sectional area to the center leg of the three leg variable inductor shown in FIG. 2A above. FIG. 7 of the '610 U.K. Patent shows a perspective view of the three leg transductor of FIG. 2A above where additional cross-sectional area of the amount of a x e is added. The additional "bodies" make it difficult if not impossible to maintain a substantially constant inductance of the control winding.

Magnetic amplifiers are known having cores with three legs, parallel windings on the outer legs and a separate winding on the center leg. U.S. Pat. No. 2,229,952 to Whiteley discloses magnetic amplifier embodiments of this type. However, magnetic amplifiers operate in accordance with different principles than variable inductors and have different inputs and outputs. For example, in the magnetic amplifiers by Whiteley mentioned above, the current in the control winding around the center leg biases the core magnetization and does not saturate the core. The core is saturated by the AC signal from the generator 4 and due to the action of diodes 5, only one outer leg is saturated at a time. Each outer leg is saturated at a different time. Each outer leg is alternately, saturated and then not saturated, every cycle of the AC signal. The current through the control winding 2 determines the part of the half cycle during which the core is in saturation. The average DC voltage output relates to the amount of current through the control winding 2. The operation of a magnetic amplifier is to control the DC output voltage in accordance with the control current in control winding 2.

SUMMARY OF THE INVENTION

It is an object of the invention to provide a variable inductor that is current controlled with a wide variation range.

It is another object of the invention to provide a variable inductor which is current controlled and has a limited control current.

A further object of the invention is to provide a variable inductor which is current controlled which does not suffer from parasitic effects.

It is an additional object of the invention to provide a current controlled variable inductor wherein the core of the circuit element having an inductance that varies is saturated.

It is still a further object of the invention to provide a variable inductor that is current controlled where the minimum inductance of the circuit element that has an inductance which varies is not limited by the magnetic permeability of the core material.

It is yet another object of the invention to provide a current controlled variable inductor which eliminates steps in cross-sections of its core.

Further it is an object of the invention to provide a current controlled variable inductor wherein the minimum inductance of the circuit element which has a variable inductance may be lower than permitted in the prior art.

Additionally, it is an object of the invention to provide a variable inductor in which the capacitance of a control winding does not limit the winding ratio.

Further, it is another object of the invention to provide a current controlled variable inductor in which a voltage across a control winding does not limit the operating frequency.

It is yet a further object of the first embodiment of the invention to provide a current controlled variable inductor wherein the inductance of a control winding is substantially constant with a change in current in the control winding.

These and other objects of the invention are accomplished by providing a variable inductor according to a first embodiment comprising a core formed of a saturable magnetic material, the core having three legs, including a center leg and two outer legs; a control winding on the center leg and windings on each of the outer legs connected in parallel and in such a way that the magnetic flux arising from currents through the windings on the outer legs is cancelled in the center leg; wherein a current through the control winding causes a changed inductance across the windings on the outer legs by changing the saturation level of the outer legs, wherein the inductance of the control winding is substantially constant with a change in current in the control winding; the magnetic cross-section of the center leg, relative to the magnetic cross-sections of the outer legs being such that the outer legs and the center leg have substantially equal saturation levels.

In a preferred embodiment, the magnetic cross-section of the center leg is equal to or somewhat larger than the sum of the magnetic cross-sections of the outer legs. Additionally, in a preferred embodiment, the portions of the core connecting the three legs are tapered down from the cross-section of the center leg to the cross-sections of the outer legs. Further, in a preferred embodiment, the center leg is formed by a single magnetic element. In still a further preferred embodiment, the portions of the core which connect the legs and the legs of the core may have circular cross-sectional areas.

Also disclosed is a method of varying the inductance of an inductive circuit element in accordance with a control current comprising: a) obtaining a three leg core of saturable magnetic material, a magnetic cross-section of a center leg of the core, relative to magnetic cross-sections of two outer legs of the core set so that the outer legs and the center will have leg substantially equal saturation levels during step d) below; b) winding parallel windings on the outer legs of the core in such a way that the magnetic flux arising from current through the parallel windings is cancelled in the center leg of the core; c) winding a control winding on the center leg of the core; and d) varying the control current on the control winding to change the saturation level of the outer legs of the core to vary the inductance of each of said parallel windings; the inductance of the control winding on the center leg of the core remaining substantially constant with changes in the current on the control winding.

It is yet another object of the second embodiment of the invention to provide a current controlled variable inductor which obtains the largest variation of inductance with the minimal control current by tapering the cross-sections of the portions of a three leg core that connect the legs of the core down from the cross-section of a center leg to the cross-sections of outer legs in order to channel all flux lines in the center leg to the outer legs.

These objects are accomplished by providing a variable inductor comprising a core formed of a saturable magnetic material, the core having three legs, including a center leg and two outer legs; a control winding on the center leg and windings on each of the outer legs connected in parallel and in such a way that the magnetic flux arising from currents through the windings on the outer legs is cancelled in the center leg; wherein a current through the control winding causes a changed inductance across the windings on the outer legs; the magnetic cross-section of the center leg, relative to the magnetic cross-sections of the outer legs, being such that the outer legs are saturated, and the center leg is not saturated and portions of the core connecting the three legs are tapered down from the cross-section of the center leg to the cross-sections of the outer legs.

Also contemplated is a second method of varying the inductance of an inductive circuit element in accordance with a control current comprising: a) obtaining a three leg core of saturable magnetic material, a magnetic cross-section of a center leg of the core, relative to magnetic cross-sections of two outer legs of the core set so that the outer legs are saturated, the center leg is not saturated and portions of the core connecting the three legs are tapered down from the cross-section of the center leg to the cross-sections of the outer legs; b) winding parallel windings on the outer legs of the three leg core in such a way that the magnetic flux arising from current through the parallel windings is cancelled in the center leg of the core; c) winding a control winding on the center leg of the core; d) varying the control current on the control winding to saturate the outer legs of the core to vary the inductance of each of the parallel windings; and e) performing the step of varying the control current to saturate the outer legs of the core while not saturating the center leg.

The above and other objects, aspects and features and advantages of the invention will be more readily apparent from the description of the preferred embodiments thereof taken in conjunction with the accompanying drawings and appended claims.

BRIEF DESCRIPTION OF THE DRAWINGS

The invention is illustrated by way of example and not limitation in the figures of the accompanying drawings in which like references denote like and corresponding parts, and in which:

FIG. 3 is a variable inductor according to the present invention;

FIG. 4A shows two E-shaped core elements clamped together to form a core with three legs for use in the present invention;

FIG. 4B is a cross-sectional view of the cores illustrated in FIG. 4A, taken along the lines 4B–4B;

FIG. 4C is a cross-sectional view of the core illustrated in FIG. 4A, taken along the line 4C–4C.

FIG. 4D is a view similar to FIG. 4C of an alternate embodiment and

FIG. 5 is a perspective view of one embodiment of the current controlled variable inductor in accordance with the present invention.

DESCRIPTION OF THE PREFERRED EMBODIMENTS

Figure 1:
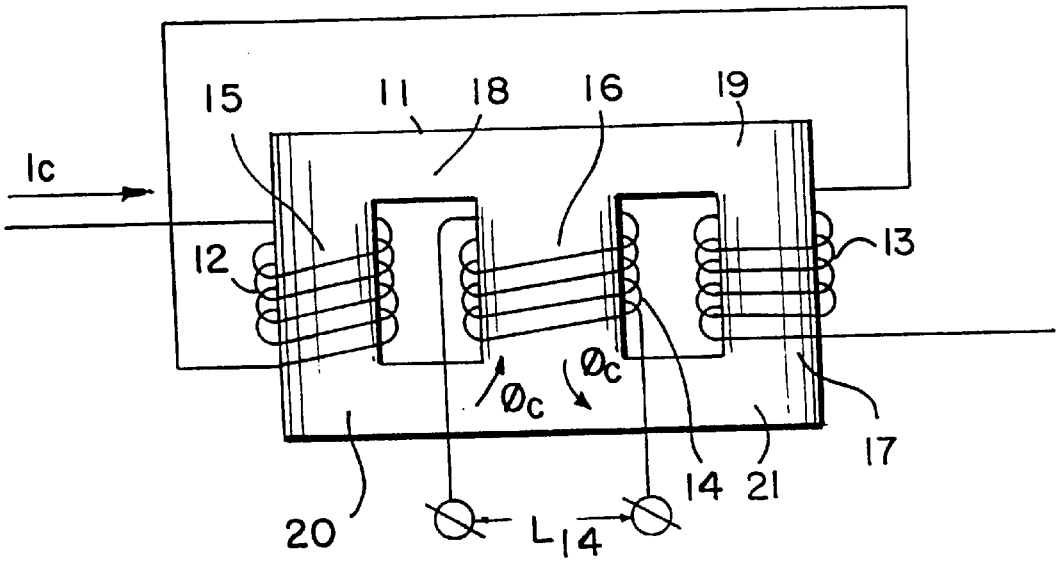
FIG. 1 (PRIOR ART)
FIG. 1 is a current controlled variable inductor in accordance with the prior art.
Figure 2A:
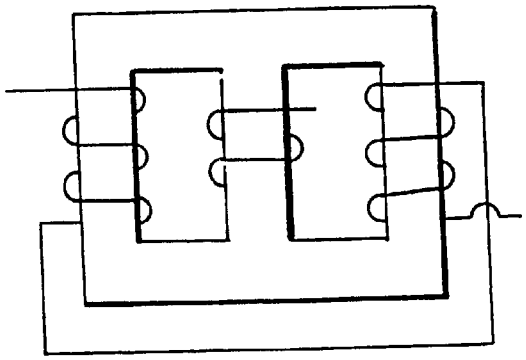
FIG. 2A ( PRIOR ART )
FIGS. 2A and 2B are additional current controlled variable inductors in accordance with the prior art.
Figure 2B:
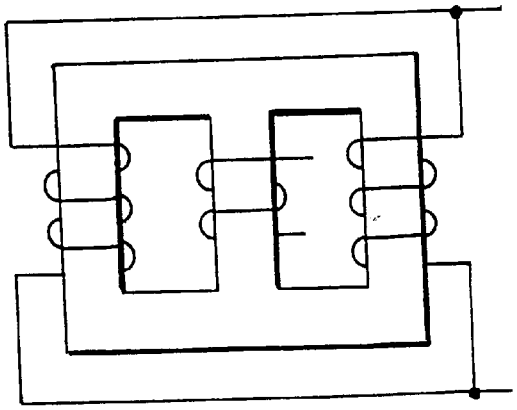
FIG. 2B (PRIOR ART)

Referring to FIG. 3, a variable inductor is shown in accordance with the invention.

The variable inductor 40 of the invention includes a core 41 formed of a saturable magnetic material. The core 41 has three legs 42, 43 and 44. Leg 43 is the center leg and legs 42 and 44 are outer legs. The center leg 43 is a single magnetic element. In other words, center leg 43 is a single piece of magnetic material throughout a cross-section cut perpendicular to the direction of the flow of flux $\phi$ along the length of the leg induced by a control current Ic during operation. A control winding 45 is wound about the center leg 43. Identical outer windings 46 and 47, respectively, are wound about the outer legs 42 and 44, respectively. The outer windings 46 and 47 are connected in parallel across a source of an AC signal and are wound in such a way that the magnetic flux $\phi_c$ induced by currents through the outer windings 46 and 47 is cancelled in the center leg 43 as shown.

The DC control current Ic is input to the control winding 45. A change in the control current Ic causes a change in the inductances $L_{46}$ and $L_{47}$ across the outer windings 46 and 47. In a first embodiment of the invention, the inductance $L_{45}$ of the control winding 45, however, remains substantially constant with a change in the control current Ic in the control winding 45.

In the first embodiment of the invention, the magnetic cross-section of the center leg 43, relative to the magnetic cross-sections of the outer legs 42 and 44, is such that the outer legs (42, 44) and the center leg (43) have substantially equal levels of saturation. In a preferred version of the first embodiment, substantially equal levels of saturation are achieved by making the magnetic cross-section of the center leg 43 equal to or slightly larger than the sum of the magnetic cross-sections of the outer legs 46 and 47. The magnetic cross-section of the center leg 43 may be somewhat larger than the sum of the magnetic cross-sections of the outer legs 42 and 44, however, the difference in magnetic cross-sections must be small enough that the center leg 43 and the outer 42 and 44 legs have substantially equal levels of saturation. Thus, if the center leg is about 80% saturated, the outer legs 42 and 44 must also be about 80% saturated.

In a second embodiment of the invention, the magnetic cross-section of the center leg 43, relative to the magnetic cross-sections of the outer legs 42 and 44, is such that the outer legs 42 and 44 are saturated, the center leg 43 is not saturated, and portions 48–51 of the core connecting the three legs are formed so that the connecting portions 48–51 are tapered down from the cross-section of the center leg 43 to the cross-sections of the outer legs 42 and 44 as further described with respect to FIG. 4B. In the second embodiment of the invention, the inductance $L_{45}$ will not remain constant with a change in the control current Ic in the control winding 45.

In the first embodiment of the invention, wherein the outer legs 42 and 44 and the center leg 43 have substantially equal levels of saturation and where the inductance of the control winding $L_{45}$ is substantially constant with a change in current in the control winding 45, a larger variation of the inductance $L_{46}$ and $L_{47}$ with a smaller control current Ic may be obtained by tapering the cross-sections of the portions 48–51 of the three leg core that connect the legs of the core, down from the cross-section of the center leg 43 to the cross-sections of the outer legs 42 and 44 in order to channel all of the flux lines in the center leg 43 to the outer legs 42 and 44. The cross-sections of the portions 48–51 may be circular or oval. Alternatively, the cross-sections of the portions may be another shape, for example rectangular. The tapering from the relatively large cross-section of the center leg 43 to the smaller cross-sections of the outer legs 42 and 44 may be formed in only one or in both dimensions of the cross-sectional shape. The greatest variation of inductance with the minimal control current Ic may only be obtained as in the second embodiment of the invention, by tapering the cross-sections of the connecting portions 48–51 of the core where the outer legs 42 and 44 are saturated and the center leg 43 is not saturated. However, as mentioned before, in the second embodiment of the invention, the inductance of the control winding $L_{45}$ does not remain substantially constant with a change in current in the control winding 45.

For both the first and the second embodiments of the invention, the entire core 41 may be formed as an integral piece of magnetic material as shown in FIG. 3 or as two E-shaped magnetic sections as shown in FIG. 4A.

More particularly, FIG. 4A illustrates a variation of the core 41 employed in the invention shown in FIG. 3 above. The core 41 has three legs 42, 43 and 44 as in FIG. 3. Additionally, the core 41 includes connecting portions 48, 49, 50 and 51 between the three legs of the core. However, in the embodiment illustrated in FIG. 4A, the core 41 is composed of two E-shaped sections of magnetic material 41*a* and 41*b*. The E-shaped sections of magnetic material 41*a* and 41*b* are clamped together such that their faces meet at boundary 52 to form the three-leg core.

FIG. 4B is a cross-sectional view of the core 41 taken along line 4B–4B in FIG. 4A. The cross-section of each leg 42, 43 and 44 is circular as shown in FIG. 4B. The cross-section of each leg 42, 43 and 44 is constant across the length of the leg as better seen in FIG. 4A. Referring to FIG.

4B, the cross-sectional area of center leg 43 is equal to or larger than the cross-sectional areas of the outer legs 42 and 44. More particularly, in the first embodiment of the invention, the magnetic cross-section of the center leg 43 is equal to or somewhat larger than the sum of the magnetic cross-sections of the outer legs 42 and 44. In the second embodiment of the invention, the magnetic cross-section of the center leg 43 may be substantially larger than the sum of the magnetic cross-sections of the center legs 42 and 44.

Further, for both the first and second embodiments of the invention, as shown in FIG. 4B, the portions 50 and 51 of the core connecting the three legs 42, 43 and 44 are tapered down from the center leg 43 toward the outer legs 42 and 44. Accordingly, the cross-sectional areas of the connecting portions 50 and 51 (as well as similar connecting portions 48 and 49) vary along the length of the connecting portions, with the cross-sectional area of each connecting portion taken close to the center leg 43 being greater than the cross-sectional area of the same connecting portion taken close to one of the outer legs 42 and 44.

FIG. 4C is a cross-sectional view of the core 41 illustrated in FIG. 4A taken along line 4C–4C. A similar cross-sectional view would be obtained if taken along a symmetrical horizontal line through connecting portions 51 and 49 and looking toward leg 44. (Further, similar views could be obtained for the core 41 of FIG. 3 but these views do not have the boundaries 52.) As shown in FIG. 4C, leg 42 (as well as legs 43 and 44, not shown in FIG. 4C) has a constant cross-sectional area along the length of the leg 42. Further, connecting portions 50 and 48 have circular cross-sectional areas. As shown in FIG. 4B, the circular cross-sectional areas of connecting portions 48 and 50 vary along the length of the connecting portions with the cross-sectional area of each of the connecting portions taken close to the outer legs 42 and 44 being smaller than the cross-sectional area of each of the connecting portions taken close to the center leg 43.

FIG. 4D is a view similar to FIG. 4C of an alternate embodiment of the core 41 illustrated in FIG. 4A showing rectangular cross-sections for the connecting portions 48 and 50. Other shapes may also be employed for the cross-sections of the connecting portions 48–51. The cross-sectional areas of the connecting portions 48–51 may vary in one or two dimensions along the length of the connecting portions, with the cross-sectional area of each connecting portion taken close to the center leg 43 being greater than the cross-sectional area of the same connecting portion when close to one of the outer legs 42 and 44.

Though center leg 43 shown in FIG. 4A comprises a first part 43*a* which is part of section 41*a* of magnetic material and a second part 43*b* which is part of section 41*b* of magnetic material, center leg 43 is still considered a "single magnetic element" as defined herein. The language "a single magnetic element" is meant to designate a magnetic element (such as a leg of a core) with a continuous single piece of magnetic material throughout at least one cross-section cut perpendicular to the direction of the flow of flux $\phi$ during operation. The magnet flux $\phi$ flows along the length of the center leg 43 during operation. The cross-section taken perpendicular to the flow of flux $\phi$ is not composed of multiple magnetic elements such as lamination strips or additional bodies added to increase the cross-section of the element. The division between sections 41*a* and 41*b* of magnetic material illustrated by boundaries 52 does not increase the cross-sectional area of the center leg 43 and does not mean that center leg 43 is composed of more than a "single magnetic element", because the cross-section, cut perpendicular to the flow of flux $\phi$ during operation, shows only a single magnetic element. The same magnetic material is employed throughout the cross-section.

In operation, for the first embodiment of the invention, where the magnetic cross-section of the center leg 43, relative to the magnetic cross-sections of the outer legs 42 and 44 is set such that the outer legs and the center leg have substantially equal levels of saturation, the control current Ic through center windings 45, causes the inductances $L_{46}$ and $L_{47}$ across the outer windings 46 and 47 to vary by changing the saturation levels of the outer legs 42 and 44. However, the inductance $L_{45}$ of the control winding 45 remains substantially constant with the change in the control current Ic through control winding 45. The control current Ic through winding 45 is large enough that the outer legs 42 and 44 of the core 41 saturate, which lowers the magnetic permeability of the core and results in a decrease in the inductances $L_{46}$ and $L_{47}$ of the parallel outer windings 46 and 47. The higher the control current Ic becomes, the lower the inductances $L_{46}$ and $L_{47}$ become.

Additionally, for the first embodiment, the connecting portions 48–51 of the core 41 may be tapered to make sure that there is a minimum incremental increase or "step" in cross-sectional area from the legs to the connecting limbs. "Steps" in cross-sectional area will leave parts of the core material non-saturated around the "steps". This limits the minimum inductance and the variation range of the inductance. The tapered connecting portions permit a greater variation in the inductances $L_{46}$ and $L_{47}$ for a given control current Ic through control winding 45.

A circular cross-section for the core 41 as opposed to another type of cross-section such as a rectangular cross-section, provides a more homogenous spread of the magnetic flux through the cross-section which results in a more homogenous saturation of the magnetic material of the legs and connecting portions. Thus, a greater variation in inductance for a given control winding current Ic may be obtained. Additionally, a circle has the shortest possible perimeter for a given cross-section. Accordingly, a given number of turns around a circular leg of the core 41 will require a shorter total length of wire than that required for legs having a different cross-sectional area such as a rectangle. The shorter total length of wire results in lower power loss in the variable inductor 40.

Other shapes for the cross-sections of the legs and connecting portions may be employed, however. Further, tapering of a cross-section of one of the connecting portions 48–51 may be in one or two dimensions. A practical embodiment employs a rectangular cross-section for the connecting portions 48–51 with tapering in only one dimension as shown in the perspective view of FIG. 5. FIG. 5 is a perspective view of the invention shown in FIG. 3.

Employing a single magnetic element (throughout a cross-section taken perpendicular to the flow of flux during operation) for the center leg permits a constant control winding inductance $L_{45}$. For the inductance of the control winding 45 to be exactly constant the following conditions are required:

1. The outer windings 46 and 47 on the outer legs 42 and 44 are connected in parallel;
2. The magnetic cross-section of the center leg 43 is equal to the sum of the magnetic cross-sections of the outer legs 42 and 44; and
3. The connecting portions 48–51 are not completely saturated. If the connecting portions are not completely saturated, the coupling of the windings stays in tact as the legs are going into saturation. The connecting portions are maintained non-saturating due to the fact that the connecting portions have larger cross-sections than the cross-sections of the outer legs. This is true when the connecting portions are tapered as illustrated.

The inductance of the control winding 45 will be substantially constant, if the magnetic cross-section of the center leg 43 is somewhat larger than the sum of the magnetic cross-sections of the outer legs 42 and 43 provided that the outer legs and the center leg have substantially equal levels of saturation.

In operation of the invention as shown in FIG. 3, the inductance $L_{45}$ of the control winding 45 on the center leg 43 is of a low value in comparison to the inductances $L_{12}$ and $L_{13}$ in the prior art circuit of FIG. 1. Further, the inductance of control winding 45 does not change significantly with a change in control current Ic. In fact, as stated above, if the magnetic cross-section of the center leg 43 is exactly equal to the sum of the magnetic cross-sections of the outer legs 42 and 44, the inductance of control winding 45 will not change at all with the control current Ic. Outer windings 46 and 47 act as short circuited secondary windings on a transformer having winding 45 as the primary winding. Thus, the inductance $L_{45}$ of control winding 45 is only determined by the leakage inductance of the transformer. Accordingly, the inductance $L_{45}$ of the control winding 45 may be a low and substantially constant value.

The greatest variation in inductance as a result of a given control current Ic is obtained where the cross-section of the center leg 43 is substantially larger than the sum of the cross-sections of the outer legs 42 and 44 and the connecting limbs are tapered down from the center leg 43 to the outer legs 42 and 44 since only the outer legs 42 and 44 will be saturated due to the control current Ic. The center leg 43 is not saturated. This describes the second embodiment of the invention. In the second embodiment of the invention, however, the inductance of the control winding 45 is not substantially constant.

In operation, if the sum of the magnetic cross-sections of the outer legs 42 and 44 is smaller than the cross-section of the center leg 43, the outer legs 42 and 44 saturate before the rest of the core. When only the outer legs 42 and 44 are saturated a greater change in inductances $L_{46}$ and $L_{47}$ with the same change in control current Ic, or a smaller change in control current Ic for the same change of inductance $L_{46}$ and $L_{47}$, is obtained. The magnetic material in outer legs 42 and 44 becomes saturated by the control current Ic. Accordingly, minimum inductances $L_{46}$ and $L_{47}$ are determined by the number of turns and not by the permeability of the magnetic material.

In contrast, for the prior art circuit of FIG. 1, the minimum inductance of winding 16 depends upon the permeability of the magnetic material because in the prior art variable inductor, the magnetic material in center leg 16 does not become saturated. Accordingly, Equation 1 above, which depends upon permeability, applies limiting the minimum inductance in that case.

The invention further contemplates a first method of varying the inductance $L_{46}$ or $L_{47}$ of an inductive circuit element 46 or 47 in accordance with a control current Ic. In the first method, a three leg core of saturable magnetic material is obtained, the magnetic cross-section of a center leg 43 of the core 41, relative to magnetic cross-sections of two outer legs 42 and 44 of the core 41 set so that the outer legs 42 and 44 and the center legs 43 have substantially equal saturation levels when the control current is varied the parallel windings 46 and 47 are wound on the outer legs 42 and 44 of the three-leg core in such a way that the magnetic flux $\phi$ arising from current through the parallel windings 46 and 47 is cancelled in the center leg 43 of the core. Further, a control winding 45 is wound on the center leg 43 of the core. The control current Ic of the control winding 45 is varied to change the saturation level of the outer legs 42 and 44 of the core 41 to vary the inductance $L_{46}$ and $L_{47}$ of each of the parallel windings 46 and 47 on the outer legs 42 and 44. The inductance $L_{45}$ of the control winding 45 on the center leg 43 of the core is maintained substantially constant with changes in the current Ic on the control winding 45.

The invention further contemplates a second method of varying the inductance $L_{46}$ or $L_{47}$ of the inducted circuit element 46 or 47 in accordance with a control current Ic. In the second method, a three leg core 41 of saturable material is obtained. The magnetic cross-section of the center leg 43 of the core 41, relative to magnetic cross-sections of two outer legs 42 and 44 of the core 41 set so that outer legs 42 and 44 are saturated, the center leg 43 is not saturated, and portions 48–51 of the core 41 connecting the three legs 42, 43 and 44 are tapered down from the cross-section of the center leg 43 to the cross-sections of the outer legs 42 and 44. The parallel windings 46 and 47 are wound on the outer legs 42 and 44 of the three leg core 41 in such a way that the magnetic flux arising from the current through the parallel winding 46 and 47 is cancelled in the center leg 43 of the core. A control winding 45 is wound on the center leg 43 of the core. The control current Ic of the control winding 45 is varied to saturate the outer legs of the core 41 to vary the inductance $L_{46}$ and $L_{47}$ of each of the parallel windings 46 and 47.

The control current Ic is varied to saturate the outer legs 42 and 44 of the core 41 while not saturating the center leg 46. The connecting portions 48–51 are not completely saturated. In fact, only the parts of the connecting portions that are closest to the outer legs are saturated.

Although the invention has been described with reference to the preferred embodiments, it will be apparent to one skilled in the art that variations and modifications are contemplated within the spirit and scope of the invention. The drawings and description of the preferred embodiments are made by way of example rather than to limit the scope of the invention, and it is intended to cover within the spirit and scope of the invention all such changes and modifications.

I claim:

1. A variable inductor comprising;

a core formed of a saturable magnetic material, said core having three legs, including a center leg and two outer legs;

a control winding on the center leg and windings on each of the outer legs connected in parallel and in such a way that the magnetic flux arising from currents through the windings on the outer legs is cancelled in the center leg;

wherein a current through the control winding causes a changed inductance across the windings on the outer legs by changing the saturation level of the outer legs, wherein the inductance of the control winding is substantially constant with a change in current in the control winding;

the magnetic cross-section of the center leg, relative to the magnetic cross-sections of the outer legs, being such that the outer legs and the center leg have substantially equal saturation levels.

2. The variable inductor as recited in claim 1, wherein the magnetic cross-section of the center leg is equal to or larger than the sum of the magnetic cross-sections of the outer legs.

3. The variable inductor as recited in claim 1, wherein the portions of the core connecting the three legs are tapered down from the center leg to the outer legs.

4. The variable inductor as recited in claim 1, wherein the center leg is formed by a single magnetic element.

5. The variable inductor as recited in claim 1, wherein at least one of the legs of the core has a substantially circular cross-section.

6. The variable inductor as recited in claim 1, wherein at least one of the portions of the core which connects the legs has a substantially circular cross-section.

7. The variable inductor as recited in claim 1, wherein the portions of the core connecting the legs are tapered in at least one dimension.

8. A variable inductor comprising;

a core formed of a saturable magnetic material, said core having three legs, including a center leg and two outer legs;

a control winding on the center leg and windings on each of the outer legs connected in parallel and in such a way that the magnetic flux arising from currents through the windings on the outer legs is cancelled in the center leg;

wherein a current through the control winding causes a changed inductance across the windings on the outer legs;

the magnetic cross-section of the center leg, relative to the magnetic cross-sections of the outer legs, being such that the outer legs are saturated, and the center leg is not saturated and portions of the core connecting the three legs are tapered down from the cross-section of the center leg to the cross-sections of the outer legs.

9. The variable inductor as recited in claim 8, wherein at least one of the legs of the core has a substantially circular cross-section.

10. The variable inductor as recited in claim 8, wherein at least one of the portions of the core which connects the legs has a substantially circular cross-section.

11. The variable inductor as recited in claim 8, wherein the portions of the core connecting the legs are tapered in at least one dimension.

12. A method of varying the inductance of an inductive circuit element in accordance with a control current comprising:

a) obtaining a three leg core of saturable magnetic material, a magnetic cross-section of a center leg of said core, relative to magnetic cross-sections of two outer legs of said core set so that the outer legs and the center leg will have substantially equal saturation levels during step d) below;

b) winding parallel windings on said outer legs of said core in such a way that the magnetic flux arising from current through said parallel windings is cancelled in said center leg of said core;

c) winding a control winding on the center leg of said core; and d) varying the control current on the control winding to change the saturation level of the outer legs of said core to vary the inductance of each of said parallel windings; the inductance of the control winding on the center leg of the core remaining substantially constant with changes in the current on the control winding.

13. A method of varying the inductance of an inductive circuit element in accordance with a control current comprising:

a) obtaining a three leg core of saturable magnetic material, a magnetic cross-section of a center leg of said core, relative to magnetic cross-sections of two outer legs of said core set so that the outer legs are saturated, the center leg is not saturated and portions of the core connecting the three legs are tapered down from the cross-section of the center leg to the cross-sections of the outer legs;

b) winding parallel windings on the outer legs of said three leg core in such a way that the magnetic flux arising from current through said parallel windings is cancelled in the center leg of the core;

c) winding a control winding on the center leg of said core;

d) varying the control current on the control winding to saturate the outer legs of said core to vary the inductance of each of said parallel windings; and e) performing the step of varying the control current to saturate the outer legs of said core while not saturating the center leg.

14. A variable inductor comprising;

a core formed of a saturable magnetic material, said core having three legs, including a center leg and two outer legs, and having homogeneous saturation of said magnetic material;

a control winding on the center leg and windings on each of the outer legs connected in parallel and in such a way that the magnetic flux arising from currents through the windings on the outer legs is cancelled in the center leg;

wherein a current through the control winding causes a changed inductance across the windings on the outer legs by changing the saturation level of the outer legs, wherein the inductance of the control winding is substantially constant with a change in current in the control winding;

the magnetic cross-section of the center leg, relative to the magnetic cross-sections of the outer legs, being such that the outer legs and the center leg have substantially equal saturation levels.

* * * * *